US008720316B2

(12) United States Patent
Deeg

(10) Patent No.: US 8,720,316 B2
(45) Date of Patent: May 13, 2014

(54) HIGH-PRESSURE FUEL PUMP

(75) Inventor: Hans-Peter Deeg, Muenklingen (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 552 days.

(21) Appl. No.: 13/045,669

(22) Filed: Mar. 11, 2011

(65) Prior Publication Data

US 2011/0219947 A1 Sep. 15, 2011

(30) Foreign Application Priority Data

Mar. 13, 2010 (DE) ..... 10 2010 011 292

(51) Int. Cl.
*F01B 31/00* (2006.01)
*F01B 3/00* (2006.01)

(52) U.S. Cl.
USPC ..... 92/87; 92/71

(58) Field of Classification Search
USPC ..... 92/57, 71, 87; 91/499; 417/269
See application file for complete search history.

(56) References Cited

U.S. PATENT DOCUMENTS

| | | | | |
|---|---|---|---|---|
| 3,597,119 A | | 8/1971 | Gratzmuller | |
| 4,583,921 A | * | 4/1986 | Wolff et al. | 417/269 |
| 4,627,793 A | | 12/1986 | Kuroyanagi | |
| 4,652,215 A | | 3/1987 | Kuroyanagi | |
| 5,273,193 A | | 12/1993 | Murakami et al. | |
| 6,142,060 A | | 11/2000 | Saito et al. | |
| 6,543,424 B1 | | 4/2003 | Yamaguchi et al. | |
| 7,320,576 B2 | * | 1/2008 | Enomoto et al. | 417/269 |

FOREIGN PATENT DOCUMENTS

| | | |
|---|---|---|
| DE | 1051063 B | 2/1959 |
| DE | 1937072 A1 | 1/1970 |
| DE | 2603230 | 8/1977 |
| DE | 3907317 A1 | 9/1989 |
| DE | 19709781 A1 | 9/1998 |
| DE | 10039169 A1 | 3/2001 |
| DE | 10327408 | 4/2004 |
| DE | 698 22 698 T2 | 2/2005 |
| EP | 0149219 | 7/1985 |
| WO | 2007061385 | 5/2007 |

OTHER PUBLICATIONS

European Search Report issued in related Application No. EP 10016081.1 on May 19, 2011.

* cited by examiner

*Primary Examiner* — Michael Leslie
(74) *Attorney, Agent, or Firm* — RatnerPrestia

(57) ABSTRACT

A high-pressure fuel pump includes a housing and a swash plate which is mounted in the housing and is arranged in an oil space of the housing. A drive shaft is connected to the swash plate and passes through a housing opening, and with a seal for the drive shaft, which seal is mounted in the housing in the region of the housing opening. The high-pressure fuel pump has a plurality of pump elements for sucking up, compressing and ejecting fuel, which pump elements can be acted upon consecutively by the rotatable swash plate. In a pump of this type, the fuel pump has at least one magnet, the magnetic force field of which acts on the oil space of the housing. Premature wear of the pump, in particular premature wear of the seal, is avoided since the magnet separates off iron-containing dirt particles found in the oil.

9 Claims, 4 Drawing Sheets

HIGH-PRESSURE FUEL PUMP

CROSS REFERENCE TO RELATED APPLICATION

This U.S. patent application claims priority to German Patent Application No. 102010011292.5, filed Mar. 13, 2010, which is incorporated by reference herein in its entirety.

FIELD OF THE INVENTION

The invention relates to a high-pressure fuel pump.

BACKGROUND OF THE INVENTION

The invention relates to a high-pressure fuel pump with a housing and a swash plate which is mounted in the housing and is arranged in an oil space of the housing, and with a drive shaft which is connected to the swash plate and passes through a housing opening, and with a seal for the drive shaft, which seal is mounted in the housing in the region of the housing opening, wherein the high-pressure fuel pump has a plurality of pump elements for sucking up, compressing and ejecting fuel, which pump elements can be acted upon consecutively by means of the rotating swash plate.

Pump arrangements having a low-pressure pump and a high-pressure pump are used in motor vehicles, in particular passenger vehicles. The low-pressure fuel pump is arranged in the fuel tank and conveys fuel to a high-pressure fuel pump which supplies fuel at a pressure of generally greater than 100 bar to combustion spaces of an internal combustion engine. Said high-pressure fuel pump is generally connected to a cylinder head of the internal combustion engine and is driven by means of the camshaft of the internal combustion engine.

DE 698 22 698 T2, which is incorporated by reference herein, discloses a high-pressure fuel pump with the features of the type already mentioned. In this case, the oil poured into the oil space constitutes a lifetime filling, and therefore the oil is not changed during the lifetime of the high-pressure fuel pump.

However, said high-pressure fuel pump has components which are subject to wear. In particular, abrasion of metallic, iron-containing particles of bearing elements of the swash plate and other optionally used elements, such as springs and sliding blocks, can be noted during the operation designed for the lifetime of the high-pressure fuel pump. Over the lifetime, an increasing and therefore cumulative accumulation of iron-containing particles arises. The particles pass, for example, into the bearings, and therefore the wear thereof is increased, and continue into the region of the seal for the drive shaft, thus increasing the risk of a loss of oil. This may lead to the pump no longer functioning, and therefore the calculated lifetime of the high-pressure fuel pump is not reached.

DE 197 09 781 A1, which is incorporated by reference herein, describes a fuel separator in which the flow passages of the separator are each provided with a magnet.

DE 103 27 408 A1, which is incorporated by reference herein, discloses a pressure damper within a high-pressure fuel pump, said pressure damper being provided with a diaphragm and a housing which, as an alternative, may be formed magnetically.

In addition, DE 39 07 317 A1, which is incorporated by reference herein, describes a fuel tank, on the bottom of which a plurality of magnets are provided. As an alternative, a plurality of magnets are provided within the fuel filter.

SUMMARY OF THE INVENTION

An object of the present invention is to provide a high-pressure fuel pump which, by means of reduction of premature wear, in particular premature wear of the seal and/or of the bearings, has a long lifetime.

The object is achieved in a high-pressure fuel pump of the type mentioned at the beginning in that the high-pressure fuel pump has at least one magnet, the magnetic force field of which acts on the oil space of the housing.

According to aspects of the invention, it is therefore provided that at least one magnet interacts with the high-pressure fuel pump. Said magnet is attached to the high-pressure fuel pump at a suitable location, said location being selected such that the magnetic force field of the magnet can act on the oil space of the housing. In particular, the magnetic force field of the respective magnet acts on a dirt collecting pocket which is assigned thereto and is on the oil space side, and therefore, as the oil flows in the oil space, metallic, iron-containing dirt particles are conducted under the action of the oil-side force field of the magnet into the dirt collecting pocket and are permanently retained there under the action of the magnet. The iron-containing dirt particles are therefore deflected under the action of the magnetic force field out of the main stream of oil being conveyed and accumulate in the region of the magnet.

Since a particularly critical region of the high-pressure fuel pump, under the aspect of wear, involves the seal for the drive shaft, the magnet and, in particular, the dirt collecting pocket should be arranged at a distance from the seal, in particular in a region of the oil space remote from the seal. The distance should be selected at least in such a manner that the dirt particles are not conveyed into the region of the seal but rather the magnet causes the dirt particles to be conveyed away from the seal. It is therefore an aim to avoid dirt particles on the seal or on the bearings, in particular on a sealing lip of a shaft sealing ring.

The dirt particles formed in the oil space are concentrated by the magnet in the dirt collecting pocket.

The at least one magnet can be placed in the interior of the high-pressure fuel pump and/or can be placed on the exterior surface of the high-pressure fuel pump.

When the at least one magnetic is arranged on the inside, said magnet is preferably connected on the oil space side of the housing to the housing and/or to the drive shaft and/or to the swash plate. Irrespective of to which of said components the magnet is connected, the mounting of the magnet can turn out to be particularly simple if the housing and/or the drive shaft and/or the swash plate have/has a receiving space, which is open to the oil space, for the magnet. The magnet can simply be inserted, in particular clamped, into said open receptacle. Of course, other types of fastening are possible.

If the housing receives the magnet, it is considered to be particularly advantageous if the radial interior surface of the housing receives the magnet. The housing therefore receives the magnet in the region of the radially outer contour of the oil space, at a point where, in particular under the action of centrifugal forces which act on the oil, it can be assumed that the dirt particles will preferably accumulate because of the relatively high specific weight. In the event of the drive shaft and/or the swash plate receiving the magnet, it is considered to be particularly advantageous if the magnet is received by the drive shaft and/or the swash plate in the region of the axis of rotation thereof. The magnet is therefore arranged at a location at which only small centrifugal forces, if any at all, act on the magnet and also on the dirt particles held by the latter.

As an alternative, the at least one magnet can be connected to the housing on that side thereof which is remote from the oil space, therefore on the exterior surface of the housing. In this case, the magnet is indeed not assigned directly to the oil but rather the magnet acts on the oil space through the housing. Nevertheless, if the magnet is dimensioned to be sufficiently powerful, the same effect can be obtained as when the magnet is arranged on the interior surface of the housing.

The arrangement of the magnet on the exterior surface of the housing makes it possible in a particularly simple manner to attach the magnet or to retrospectively equip the high-pressure fuel pump with the magnet. All that is required for this purpose is to attach the magnet to the outside of the housing or to design or remodel the housing with an outwardly open receptacle for the magnet.

The desired dirt catching effect can be achieved in a particularly simple manner at minimum cost if the respective magnet is a permanent magnet.

BRIEF DESCRIPTION OF THE DRAWINGS

A preferred exemplary embodiment of the invention is illustrated in the drawing and described in more detail below. In the drawing.

DETAILED DESCRIPTION OF THE DRAWINGS

Figure 1:
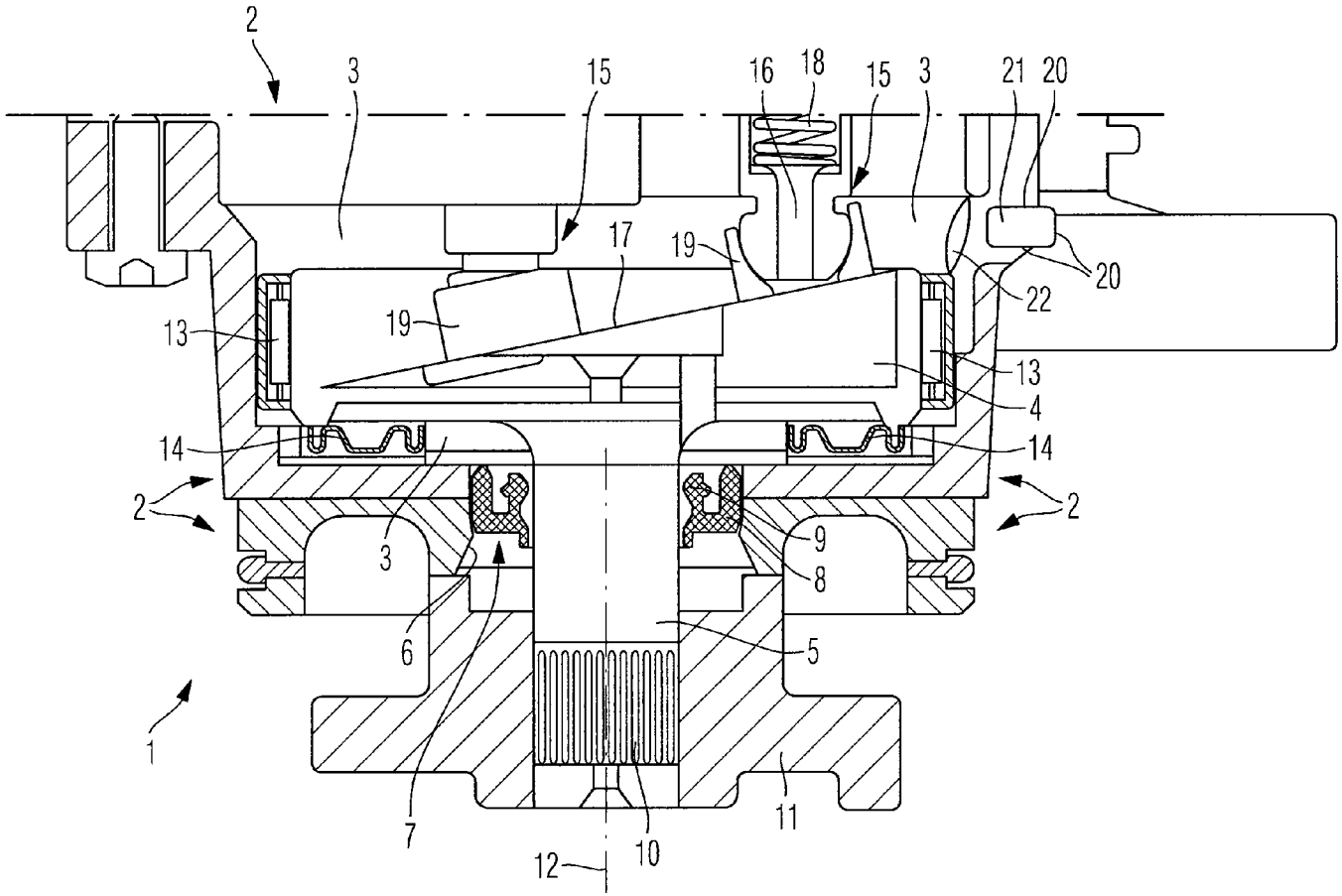
FIG. 1 shows a section through the high-pressure fuel pump, illustrated for the region of a housing, a swash plate and a shaft of the high-pressure fuel pump to which a magnet is assigned.
Figure 3:
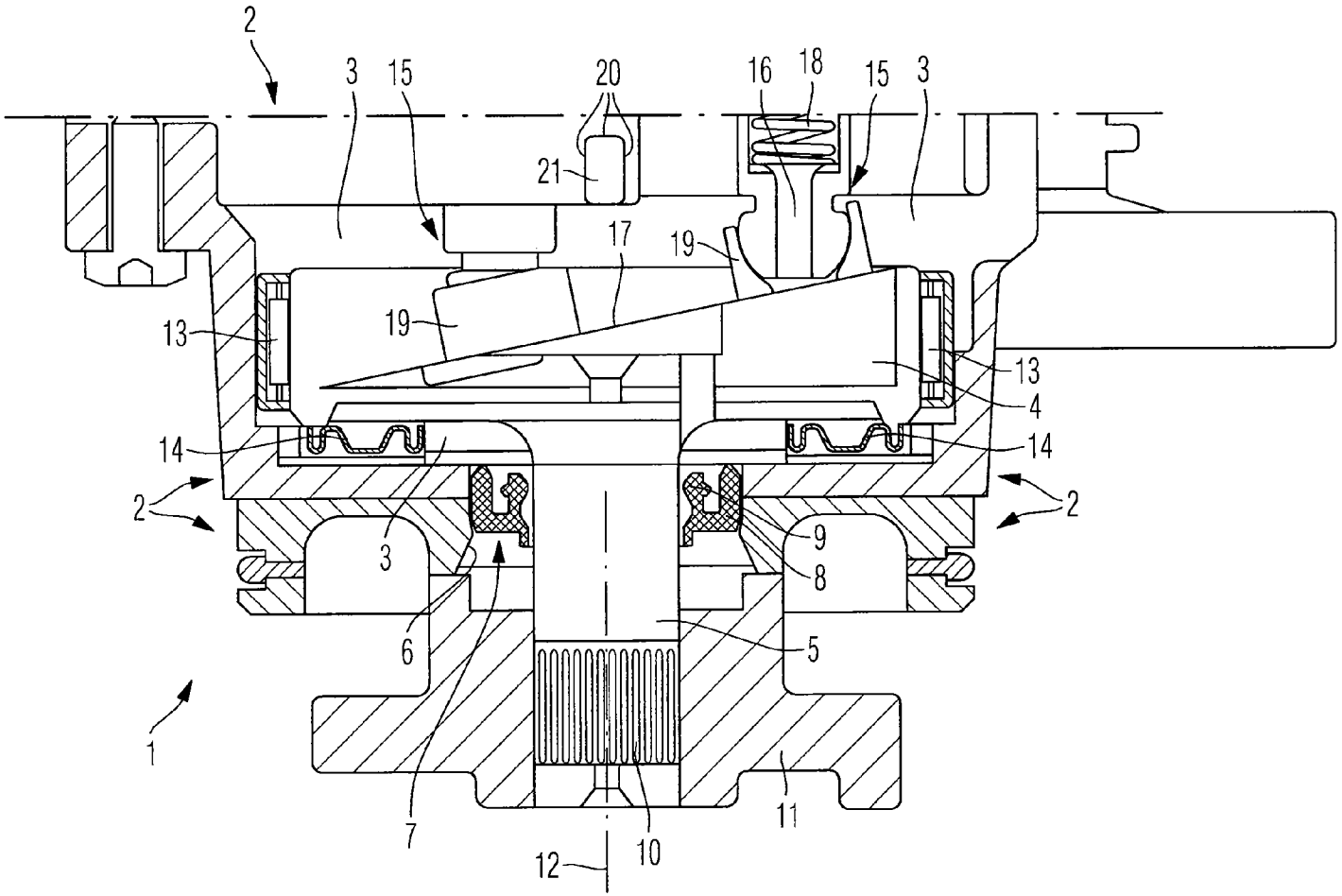

The embodiments illustrated in FIGS. 1 and 3 show a high-pressure fuel pump 1 in that region which receives the driving elements for pump elements, wherein said pump elements serve to suck up, compress and eject fuel. That region of the high-pressure fuel pump through which fuel does not flow is therefore illustrated.

In detail, as regards the high-pressure fuel pump 1, a housing 2, a swash plate 4 which is mounted in the housing 2 and is arranged in an oil space 3 of the housing 2, and a drive shaft 5 which is connected to the swash plate 4 are shown. Said drive shaft passes through a housing opening 6, wherein a seal 7 which is designed as a shaft sealing ring 8 with a sealing lip 9, the latter bearing against the drive shaft 5, is mounted in the housing 2 in the region of said housing opening 6. That end of the drive shaft 5 which is arranged outside the housing 2 has a splined shaft section 10 onto which a coupling element 11, which is fixed axially, is fitted, the coupling element 11 engaging in a camshaft (not illustrated) of an internal combustion engine. The housing pump 1 is connected to a cylinder head of the internal combustion engine, and in particular is flange-mounted on the cylinder head in a manner not shown.

The reference number 12 denotes the axis of rotation of the drive shaft 5 and swash plate 4. Said swash plate is mounted in the housing 2 via a radial bearing 13 and via an axial bearing 14, which are each designed as needle bearings.

Two of three pump elements 15 of the high-pressure fuel pump are illustrated, the pump pistons 16 of which are acted upon consecutively by means of the swash plate 4 rotating about the axis 12, with the consequence that fuel is sucked up, compressed and ejected in a manner not illustrated specifically, for the purpose of feeding the fuel to the internal combustion engine. That surface 17 of the swash plate 4 which is inclined with respect to the perpendicular to the axis of rotation 12 makes contact with the pump pistons 16, with the respective pump piston 16 being pressed against the surface 17 of the swash plate 4 under the action of a spring 18.

The oil space 3 is filled with hydraulic oil, specifically in the form of a lifetime filling, and therefore the hydraulic oil remains in the oil space 3 throughout the entire lifetime of the high-pressure fuel pump 1. During said long service life of the high-pressure fuel pump 1, wear of the individual components in the illustrated region of interest of the high-pressure fuel pump can be noted, with the consequence of abrasion of dirt particles, in particular in the region of the radial bearing 13 and of the axial bearing 14 with the needles and bearing springs arranged there, and also in the region of sliding blocks 19 which serve for the actual contact connection of a spherical-head-shaped end of the pump pistons 19 with the swash plate 4.

Said accumulation of dirt particles, which in particular are metallic and have iron-containing components, the accumulation of particles accumulating over the lifetime, results in an increased risk of the components which face the oil space 2 being subject to increased wear. In particular, there is an increased risk of the sealing lip 9 of the seal 7 becoming worn and therefore no longer ensuring the tightness of the housing 2. The consequence would be a reduction in the lifetime of the high-pressure fuel pump 1.

In order to separate off dirt particles which contain iron constituents and are moved in the oil space 3 during operation of the high-pressure fuel pump 1, the embodiment according to FIG. 1 makes provision for the interior surface of the housing 2, the side therefore which is directly adjacent to the oil space 3, to have a recess 20 which is open toward the oil space 3 and into which a relatively short, bar-shaped magnet 21, which is in the form of a permanent magnet, is inserted in a clamping manner. Said magnet is arranged radially on the outside at a location where, because of the design of the high-pressure fuel pump 1, dirt particles in particular collect. The magnet 21 is arranged set back somewhat and is therefore arranged radially further on the outside, thus forming a dirt collecting pocket 22 in the housing 2 somewhat further radially on the inside. Said dirt collecting pocket 22 forms a reservoir for dirt particles which are accordingly collected locally and are not only attracted by the magnet 21 but also, upon positioning in the dirt collecting pocket 22, are kept permanently in the latter. The magnet 21 can draw the dirt particles into the region of the dirt collecting pocket 22 because the magnetic force field of said magnet acts on the oil space 3 of the housing 2, at least in that region of the oil space 3 which is adjacent to the dirt collecting pocket 22. Dirt particles which are conveyed continuously through the oil space 3 are therefore is conveyed away into the dirt collecting pocket 22 when said dirt particles enter the force field of the magnet. This effectively avoids the dirt particles entering the region of the seal 7 or of the bearings 13 and 14.

Figure 2:
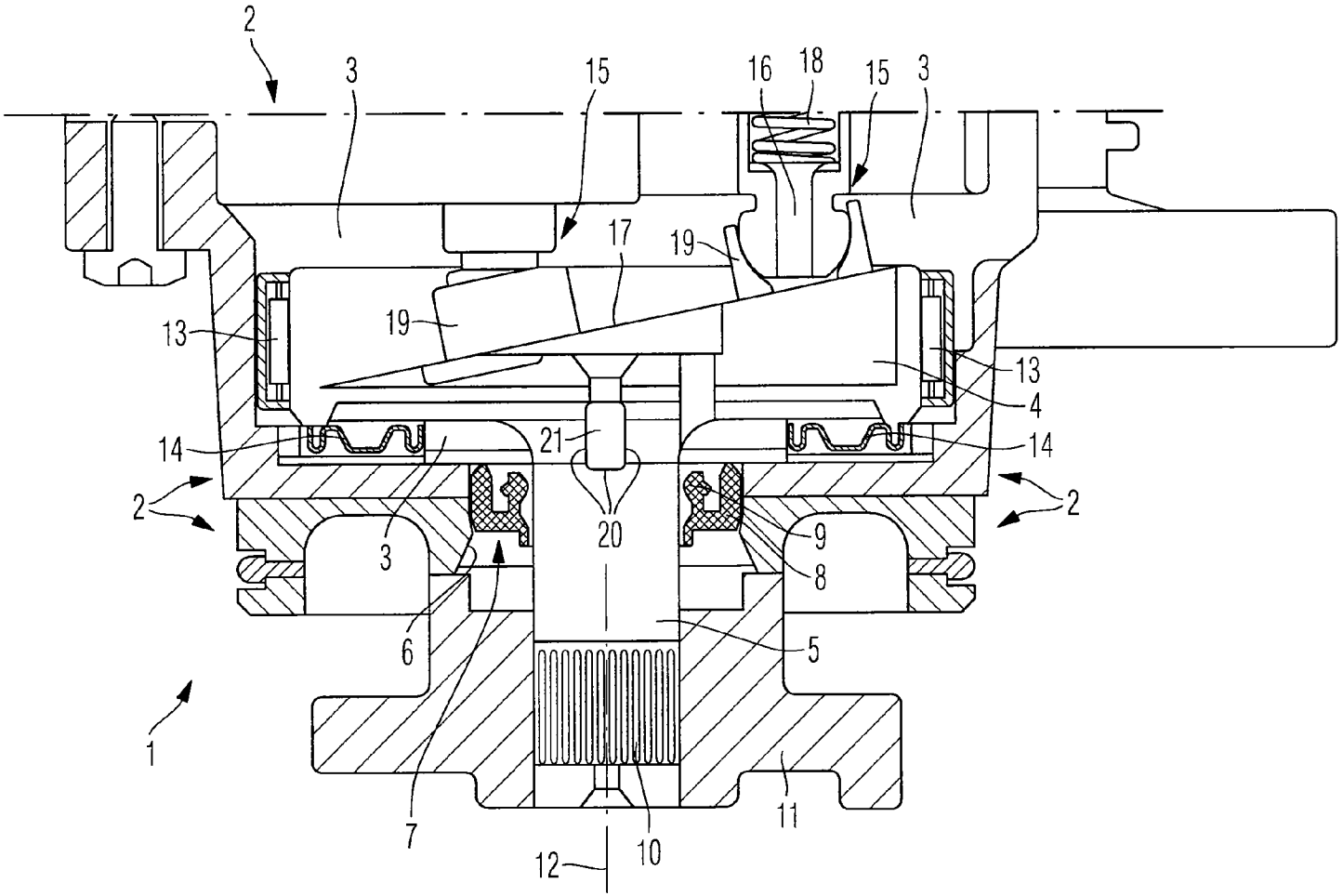
FIGS. 2 through 4 show sectional illustrations according to FIG. 1 for a modified arrangement of the magnet.

FIG. 2 shows a modification of the illustrated region of the high-pressure fuel pump 1 to the effect that the magnet 21 is not mounted in the housing 2 but rather in the drive shaft 5 concentrically with respect to the axis of rotation 12, in the region of that end of the drive shaft 5 which faces the swash plate 4. In this respect, the drive shaft 5 is provided there with a corresponding recess 20 which serves to receive the magnet 21 which is inserted into the latter under prestress. Dirt particles which are conveyed in the region of this end of the drive shaft 5 and of that region of the swash plate 4 which is assigned to the drive shaft 5 are therefore drawn onto the magnet 21 by means of the latter and collected there.

The embodiment according to FIG. 3 differs from that according to FIGS. 1 and 2 in that the magnet 21 is now mounted in the region of the housing 2, in particular in a housing cover through which the pump pistons 16 pass.

Figure 4:
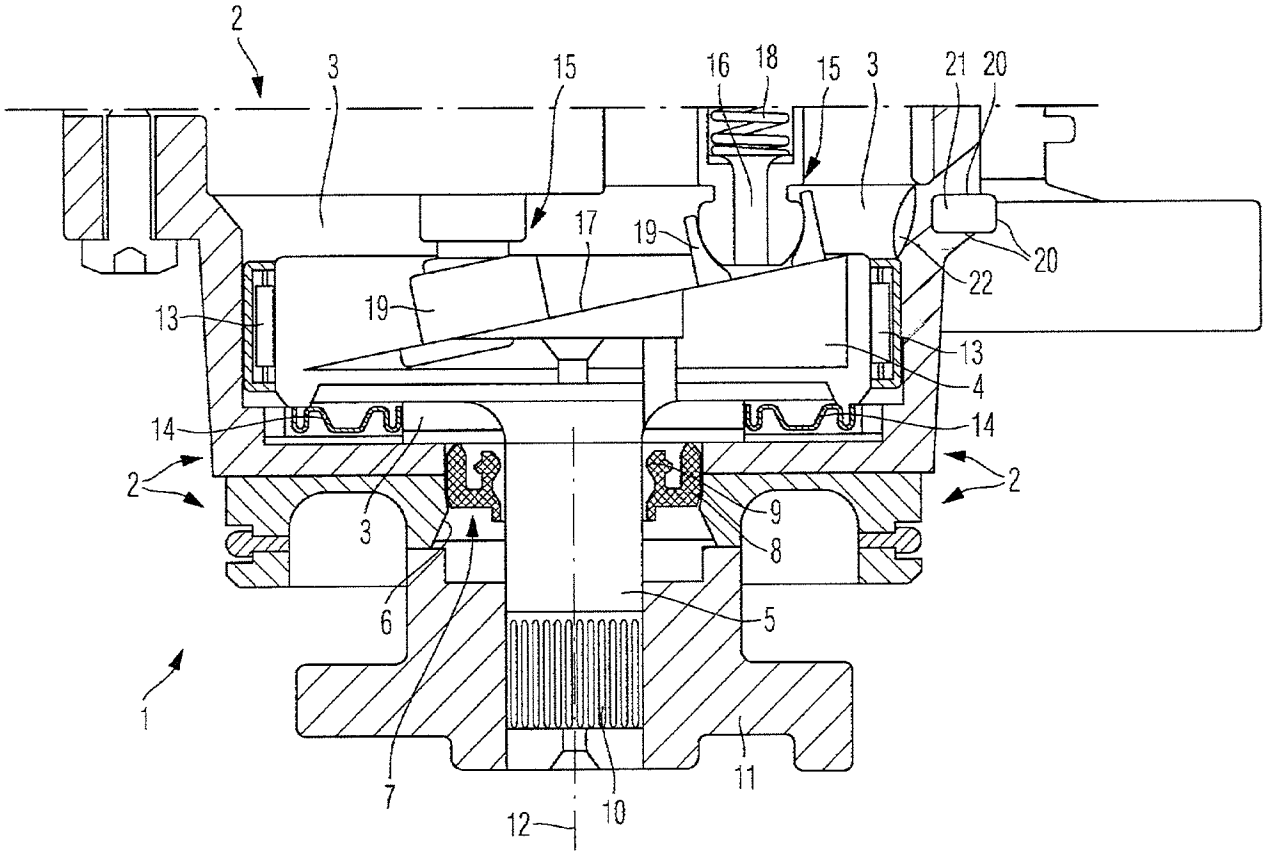

As shown in FIG. 4, the magnet 21 may absolutely also be arranged at different locations in the housing 2, in particular on the exterior surface of the housing 2, and therefore the magnet 1 does not come into contact with the hydraulic oil found in the oil space 3. Under this aspect, a simple modification of the embodiment according to FIG. 1 makes provision for a bore to be inserted into the housing 2 from the outside, the bore therefore forming the recess 20 into which the magnet 21 is inserted. It is entirely possible in this case for a dirt collecting pocket 22, facing the oil space 3, to be provided, as illustrated for the embodiment according to FIG. 1. The magnet 21 should be arranged in such a manner that the action of the magnetic force field thereof extends into the oil space 3. embodiment according to FIG. 1. The magnet 21 should be arranged in such a manner that the action of the magnetic force field thereof extends into the oil space 3.

LIST OF REFERENCE NUMBERS

1 high-pressure fuel pump
2 housing
3 oil space
4 swash plate
5 drive shaft
6 housing opening
7 seal
8 shaft sealing ring
9 sealing lip
10 splined shaft section
11 coupling element
12 axis of rotation
13 radial bearing
14 axial bearing
15 pump element
16 pump piston
17 surface
18 spring
19 sliding block
20 recess
21 magnet
22 dirt collecting pocket

The invention claimed is:

1. A high-pressure fuel pump comprising:

a housing and a swash plate which is mounted in the housing and is arranged in an oil space of the housing, a drive shaft which is connected to the swash plate and passes through a housing opening, a seal for the drive shaft, which seal is mounted in the housing in a region of the housing opening, a plurality of pump elements for sucking up, compressing and ejecting fuel, which pump elements can be acted upon consecutively by the rotatable swash plate, and at least one magnet, a magnetic force field of which acts on the oil space of the housing, wherein the magnet is external to the oil space of the housing for drawing dirt particles into at least one dirt collecting pocket.

2. The pump as claimed in claim 1, wherein the at least one dirt collecting pocket is provided on an oil space side of the housing, said dirt collecting pocket being arranged in an oil-side force field of the magnet.

3. The pump as claimed in claim 2, wherein the dirt collecting pocket is arranged in a region of the oil space remote from the seal.

4. The pump as claimed in claim 1, wherein the at least one magnet is connected to the housing on a side thereof.

5. The pump as claimed in claim 1, wherein the housing has a receptacle, which is open to an exterior surface of the housing, for accommodating the magnet.

6. The pump as claimed in claim 1, wherein the magnet is a permanent magnet.

7. A high-pressure fuel pump comprising:

a housing and a swash plate which is mounted in the housing and is arranged in an oil space of the housing, a drive shaft which is connected to the swash plate and passes through a housing opening, a seal for the drive shaft, which seal is mounted in the housing in a region of the housing opening, a plurality of pump elements for sucking up, compressing and ejecting fuel, which pump elements can be acted upon consecutively by the rotatable swash plate, and at least one magnet, a magnetic force field of which acts on the oil space of the housing, is mounted in the drive shaft for attracting dirt particles in the oil space.

8. The pump as claimed in claim 7, wherein the magnet is a permanent magnet.

9. The pump as claimed in claim 7, wherein the magnet is received by the drive shaft in a region of an axis of rotation of the drive shaft and by the swash plate in a region of an axis of rotation of the swash plate.

* * * * *